United States Patent [19]

Stüdli

[11] 4,122,374

[45] Oct. 24, 1978

[54] CIRCUIT ARRANGEMENT FOR INCREASING THE LUMINUOUS FLUX IN FLUORESCENT TUBE HAND LAMPS

[76] Inventor: Rudolf Stüdli, Burggrabenstrasse 24, CH-8280 Kreuzlingen, Switzerland

[21] Appl. No.: 765,514

[22] Filed: Feb. 4, 1977

[30] Foreign Application Priority Data

Feb. 6, 1976 [DE] Fed. Rep. of Germany ..... 2604730

[51] Int. Cl.[2] ..... H05B 41/14

[52] U.S. Cl. ..... 315/98; 315/101; 315/205; 315/DIG. 5

[58] Field of Search ..... 315/205, 98, 99, 101, 315/205, DIG. 5, 94

[56] References Cited

U.S. PATENT DOCUMENTS 4,008,414 2/1977 Agnew ..... 315/105 X

FOREIGN PATENT DOCUMENTS 2,500,580 7/1976 Fed. Rep. of Germany ..... 315/101

*Primary Examiner*—Alfred E. Smith

*Assistant Examiner*—Charles F. Roberts

*Attorney, Agent, or Firm*—Scully, Scott, Murphy & Presser

[57] ABSTRACT

A circuit for the operation of fluorescent lamps which allows the current through the lamps to be raised above the manufacturer recommended limit without adversely effecting the lamps. Two oppositely poled diodes are connected to the two contact pins at each end of the lamps, and an AC voltage is applied thereto. The arrangement results in current through two properly poled diodes during one half cycle of the applied voltage, and through the two oppositely poled diodes during the second half cycle of the voltage. As a result of this alternate loading, the thermal stress on the lamp electrodes is substantially lowered, and the current through the lamp may be raised above the recommended limit. The AC voltage is preferably at a high frequency, for example twenty kilohertz, which results in illumination from the lamps originating along the glass walls due to the skin effect, and increases the illumination efficiency of the lamps.

3 Claims, 1 Drawing Figure

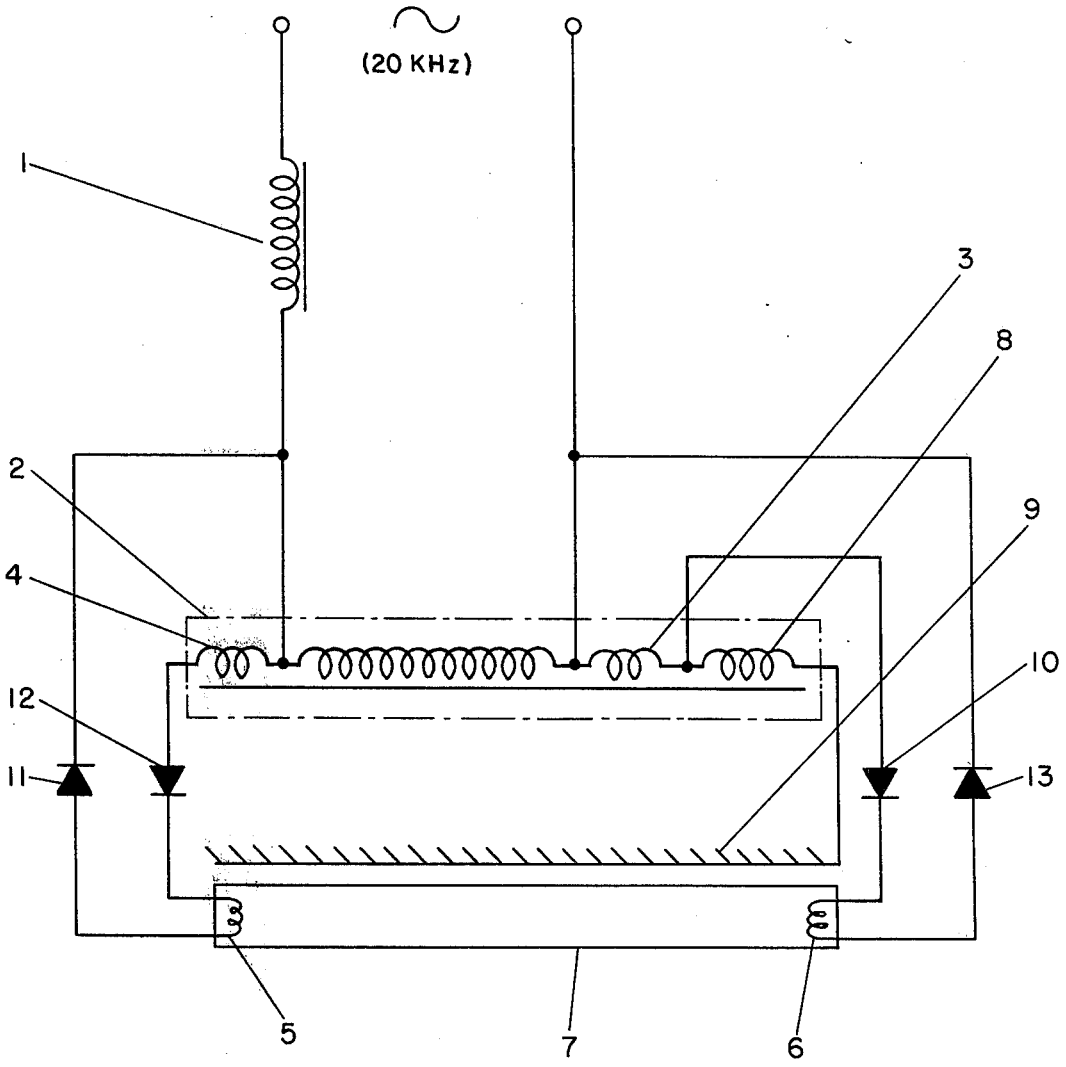
(20 KHz)
1
2
3
4
5
6
7
8
9
10
11
12
13

CIRCUIT ARRANGEMENT FOR INCREASING THE LUMINUOUS FLUX IN FLUORESCENT TUBE HAND LAMPS

Fluorescent tube hand lamps wherein the fluorescent tubes are operated in a manner known per se by means of a current-limiting reactor and a starter or, in the case of d.c. supply, by means of transistor ballasts operating at radio frequency have already been known.

To obtain higher luminous intensity, also two tubes were arranged side by side, and in other cases a fluorescent tube of abnormally large size was provided. The result in both cases was that the assembly became heavy, unhandy and expensive.

The invention relates to a circuit arrangement for operating fluorescent lamps which permits of raising the lamp current without damage substantially above the value indicated by the lamp manufacturers, without any disadvantages with respect to the service life of the lamp resulting from this step.

The invention lies in the feature that each contact pin of the fluorescent lamp has a suitably poled diode connected in series therewith, the polarity of the diodes being different within each pair of pins.

The circuit arrangement and its mode of operation will be explained with reference to the attached drawing.

The drawing shows an a.c. supplied fluorescent lamp ballast comprising a reactor 1 and an ignition and filament supply transformer 3. When the lamp is connected to the a.c. mains, the fluorescent tube still is in the unignited state so that the full line voltage appears across the two electrodes. The two filament windings 3 and 4 of the ignition transformer 2 cause the two electrodes 5 and 6 of the fluorescent lamp 7 to glow. At the same time furthermore an auxiliary ignition voltage applied to the winding 8 of the ignition transformer 2 is transmitted to the reflector 9. As a result, a weak auxiliary ignition current of a capacitive type flows through glass wall and gas of the fluorescent lamp to the electrode 5, whereby ignition of the lamp will safely be effected also at low ambient temperatures. When the lamp is in the ignited state, the voltage between the two electrodes breaks down to the so-called arc drop voltage and simultaneously also the filament voltage on the windings 3 and 4 drops to about 50% of its original value so that the remaining filament power constitutes about one fourth of the preceding power value. Ballasts of this type have been approved by the lamp manufacturers.

The four diodes employed fulfil the following function: Assuming that the voltage applied to the electrode 6 just is positive relative to electrode 5, the current flows via the diode 10 through the associated tube pin to the electrode 6, through the gas of the fluorescent lamp 7 to the electrode 5, and returns to the line through the diode 11. During the next half-cycle the current accordingly flows through the diode 12 and the electrode 5 to the electrode 6 and finally returns via the diode 13.

Owing to this method of operation the electrodes are loaded one time at the origin of the first pin and during the next half-cycle at the origin of the second pin. As a result of this alternating loading, the thermal stress on the electrodes is substantially lower and thus the lamp current can be raised considerably above the standard data. The luminous flux can be increased without damage by at least 50%.

In combination with this diode circuit a further increase in the luminous efficiency of the lamp can be obtained by using a transistor ballast operating at a very high operating frequency of, at least 20 kilocycles per second for example, 50 kilocycles per second as ballast in the case of d.c. supply. In such a case the so-called discharge arc is not in the center of the lamp, but assumes a tubular shape while following a path very close to the glass wall. This behavior is due to the so-called skin effect. Since in this case the current is guided along the phosphor coating in close proximity thereto, the lamp undergoes an improvement in efficiency of about 20% on account of this effect alone. In combination with the high operating frequency the diode circuit found thus provides a substantial increase of the luminous flux of the fluorescent lamp.

A quite specific advantage is afforded by the inventive arrangement especially for the operation of hand lamps since a relatively large quantity of light is available even when the hand lamp is equipped with only one tube and the resulting unit is of small size.

What is claimed is:

1. A circuit arrangement for increasing the luminous flux in a hand lamp having a fluorescent tube, characterized in that each of the four contact pins of said fluorescent tube has a suitably poled diode connected in series therewith, the polarity of the diodes being different within each pair of pins.

2. The circuit arrangement for increasing the luminous flux in a hand lamp having a fluorescent tube according to claim 1, wherein a high frequency operating voltage is coupled to said tube.

3. The circuit arrangement for increasing the luminous flux in fluorescent tube hand lamp according to claim 2, said high frequency operating voltage having a frequency of at least twenty kilohertz.

* * * * *